US012674288B2

(12) United States Patent
Philbin

(10) Patent No.: US 12,674,288 B2
(45) Date of Patent: Jul. 7, 2026

(54) BOARDWALK SYSTEM

(71) Applicant: Jason Vincent Philbin, Charlotte, NC (US)

(72) Inventor: Jason Vincent Philbin, Charlotte, NC (US)

(73) Assignee: PERMATRAK NORTH AMERICA LLC, Charlotte, NC (US)

( * ) Notice: Subject to any disclaimer, the term of this patent is extended or adjusted under 35 U.S.C. 154(b) by 737 days.

(21) Appl. No.: 17/592,678

(22) Filed: Feb. 4, 2022

(65) Prior Publication Data

US 2022/0243408 A1 Aug. 4, 2022

Related U.S. Application Data

(60) Provisional application No. 63/145,714, filed on Feb. 4, 2021.

(51) Int. Cl.

| | |
|---|---|
| ***E01D 19/02*** | (2006.01) |
| ***E01D 19/08*** | (2006.01) |
| ***E01D 19/12*** | (2006.01) |
| *E01D 101/24* | (2006.01) |

(52) U.S. Cl.

CPC ..... *E01D 19/02* (2013.01); *E01D 19/086* (2013.01); *E01D 19/125* (2013.01); *E01D 2101/24* (2013.01)

(58) Field of Classification Search

CPC ..... E04B 1/003; E01D 19/086; E01D 19/125; E01D 19/02; E01D 2101/24; E01D 15/133

USPC ..... 52/177, 169.9, 263, 650.3, 414

See application file for complete search history.

(56) References Cited

U.S. PATENT DOCUMENTS

| | | | | | |
|---|---|---|---|---|---|
| 3,130,470 | A * | 4/1964 | Bowden | E04G 11/48 | 211/186 |
| 3,311,939 | A * | 4/1967 | Fujita | E01D 19/125 | 52/579 |
| 3,397,858 | A * | 8/1968 | Williams | E04G 11/50 | 248/214 |
| 3,470,663 | A * | 10/1969 | Tate | E04F 15/02482 | 52/126.6 |
| 3,529,393 | A * | 9/1970 | Wilkins | E04C 2/365 | 52/843 |
| 4,201,023 | A * | 5/1980 | Jungbluth | E04B 5/14 | 52/654.1 |
| 4,858,399 | A * | 8/1989 | Salato, Jr. | E04B 1/003 | 52/410 |
| 5,245,805 | A * | 9/1993 | Takeda | H02G 3/285 | 52/177 |

(Continued)

OTHER PUBLICATIONS

Zheng et al., Research on Grooved Concrete Pavement Based on the Durability of Its Anti-Skid Performance; May 30, 2018; https://www.mdpi.com/2076-3417/8/6/891.*

(Continued)

*Primary Examiner* — Brian E Glessner
*Assistant Examiner* — Adam G Barlow
(74) *Attorney, Agent, or Firm* — Thompson Hine LLP

(57) ABSTRACT

A boardwalk system including a plurality of treads, each tread including a plurality of grooves extending entirely or substantially entirely thereacross in a transverse direction, wherein each tread is made of concrete. The system further includes a plurality of bases, each base being supported on a ground surface and positioned below each tread at or adjacent to a corner of the associated tread.

22 Claims, 6 Drawing Sheets

(56) References Cited

U.S. PATENT DOCUMENTS 5,398,466 A * 3/1995 Oyama ..... E04F 15/02458 52/126.6
5,819,491 A * 10/1998 Davis ..... E04F 15/02161 52/592.1
5,906,084 A * 5/1999 Millington ..... E01D 19/125 52/263
5,950,377 A * 9/1999 Yoder ..... E04F 15/10 52/177
6,718,714 B1 * 4/2004 Montgomery, Sr. ..... F24D 13/022 52/177
RE41,140 E * 2/2010 Heath ..... E04B 5/026 52/579
8,302,362 B2 * 11/2012 Rischmueller ..... E01D 19/125 52/177
8,522,505 B2 * 9/2013 Beach ..... E04B 5/023 403/92
8,695,288 B2 * 4/2014 Kugler ..... E04F 15/0247 52/126.5
8,833,007 B2 * 9/2014 Tillery ..... E04F 15/22 52/177
8,839,588 B2 * 9/2014 Philbin ..... F16B 1/00 52/715
9,096,975 B2 * 8/2015 Rischmueller ..... E01D 1/00
9,803,377 B2 * 10/2017 Pelc, Jr. ..... E04F 15/0247
D925,068 S 7/2021 Savarton
D940,912 S 1/2022 Savarton
11,306,451 B2 * 4/2022 Turner ..... E01D 19/125
2002/0178661 A1 * 12/2002 Burke, III ..... B32B 25/00 52/749.11
2003/0033768 A1 * 2/2003 Cikesh ..... E04B 5/48 52/783.17
2004/0025858 A1 * 2/2004 Barenberg ..... B28B 23/00 125/1
2004/0055235 A1 * 3/2004 Valentine ..... E01C 11/106 52/396.04
2005/0028463 A1 * 2/2005 Pantev ..... E04F 15/02458 52/220.1
2005/0050657 A1 * 3/2005 Zimmerlee ..... E02B 3/068 14/75
2005/0102914 A1 * 5/2005 Fazekas ..... E04B 5/026 52/58
2005/0204662 A1 * 9/2005 Showers ..... E04F 15/10 52/263
2007/0186498 A1 * 8/2007 Buzon ..... E04F 15/02161 52/489.1
2007/0261324 A1 * 11/2007 Munson ..... E04F 11/116 52/177
2010/0186338 A1 * 7/2010 Rischmueller ..... E01C 15/00 52/655.1
2011/0016809 A1 * 1/2011 Knight, III ..... E04F 15/02452 52/263
2012/0272589 A1 * 11/2012 Kugler ..... E04F 15/02183 52/582.1
2012/0304571 A1 * 12/2012 Beach ..... E04F 15/04 52/745.05
2013/0061552 A1 * 3/2013 Beach ..... E01D 19/125 52/745.05
2013/0086864 A1 * 4/2013 Marriott ..... E04F 15/02016 52/655.1
2013/0219824 A1 * 8/2013 Philbin ..... E04F 11/1812 52/745.21
2015/0082734 A1 * 3/2015 Leines ..... E04B 5/026 52/650.3
2022/0243408 A1 8/2022 Philbin
2023/0160219 A1 * 5/2023 Murata ..... E04F 13/16 52/177

OTHER PUBLICATIONS

Attachment A; sketch shared with potential customer; Nov. 2, 2019.

* cited by examiner

BOARDWALK SYSTEM

This application claims priority to U.S. Provisional Patent Application Ser. No. 63/145,714, filed on Feb. 4, 2021, the entire contents of which are hereby incorporated by reference.

The present disclosure is directed to a boardwalk system, and more particularly, to a boardwalk system that includes various modular components for easy installation.

BACKGROUND

Modular decking systems often include a beam or set of beams which extend in the longitudinal direction and support a set of treads thereon. The treads are typically horizontally oriented and provide a generally flat surface upon which a user can walk, ride small vehicles, etc. However, many existing systems can be difficult and/or time consuming to install, may not provide sufficient flexibility in installation and use, and may present too large of a height/profile.

SUMMARY

In one embodiment the invention is a boardwalk system including a plurality of treads, each tread including a plurality of grooves extending entirely or substantially entirely thereacross in a transverse direction, wherein each tread is made of concrete. The system further includes a plurality of bases, each base being supported on a ground surface and positioned below each tread at or adjacent to a corner of the associated tread.

DETAILED DESCRIPTION

Figure 1:
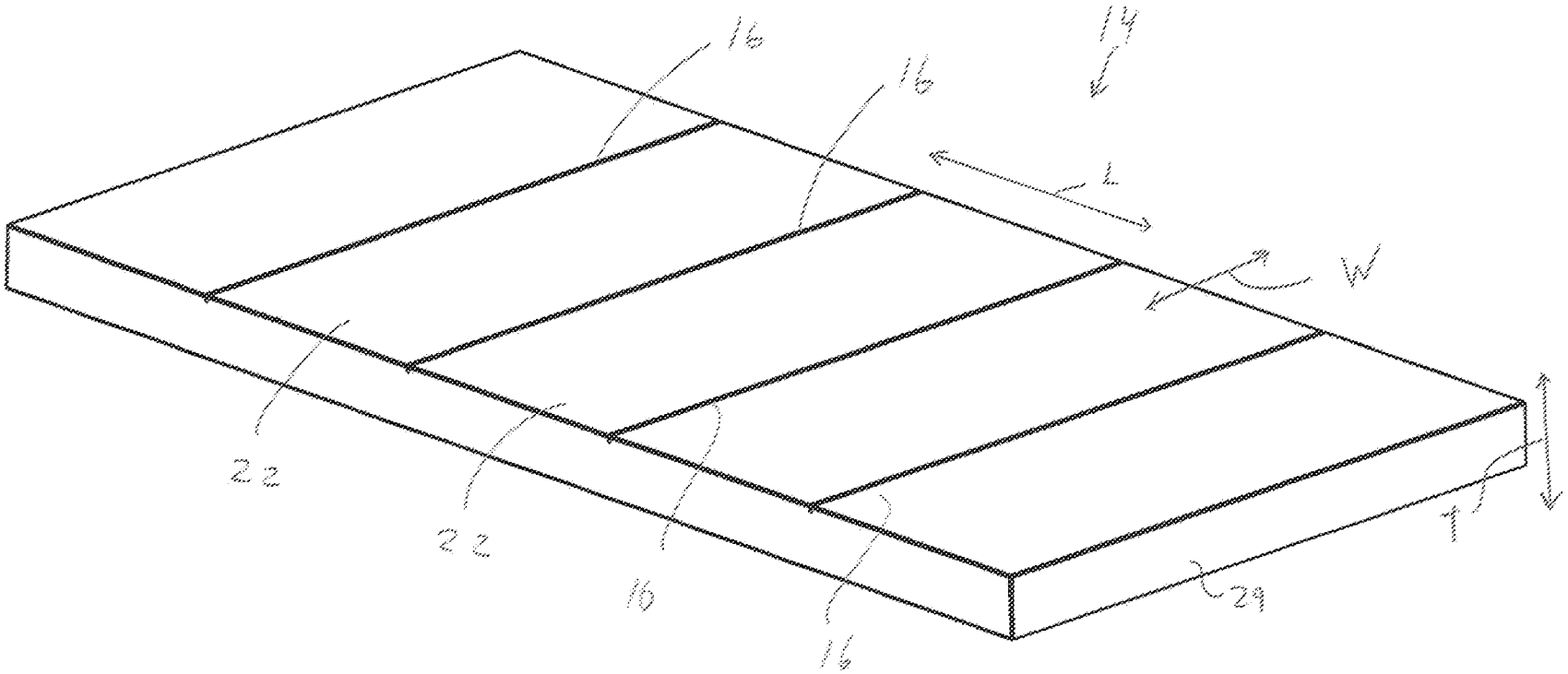
FIG. 1 is a front perspective view of one embodiment of a tread used in a boardwalk system.
Figure 2:
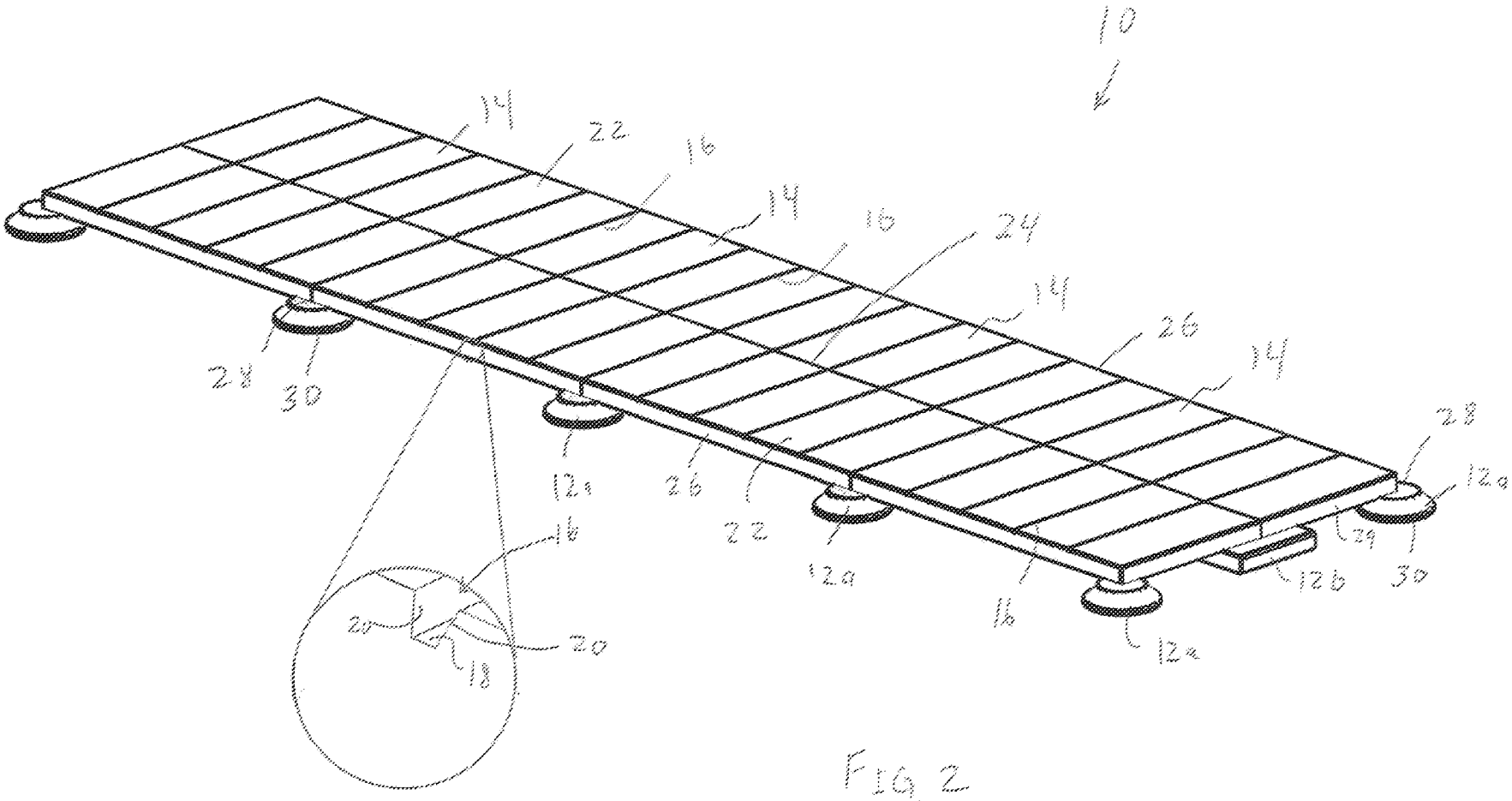
FIG. 2 is a front perspective view of a boardwalk system utilizing the tread of FIG. 1.
Figure 3:
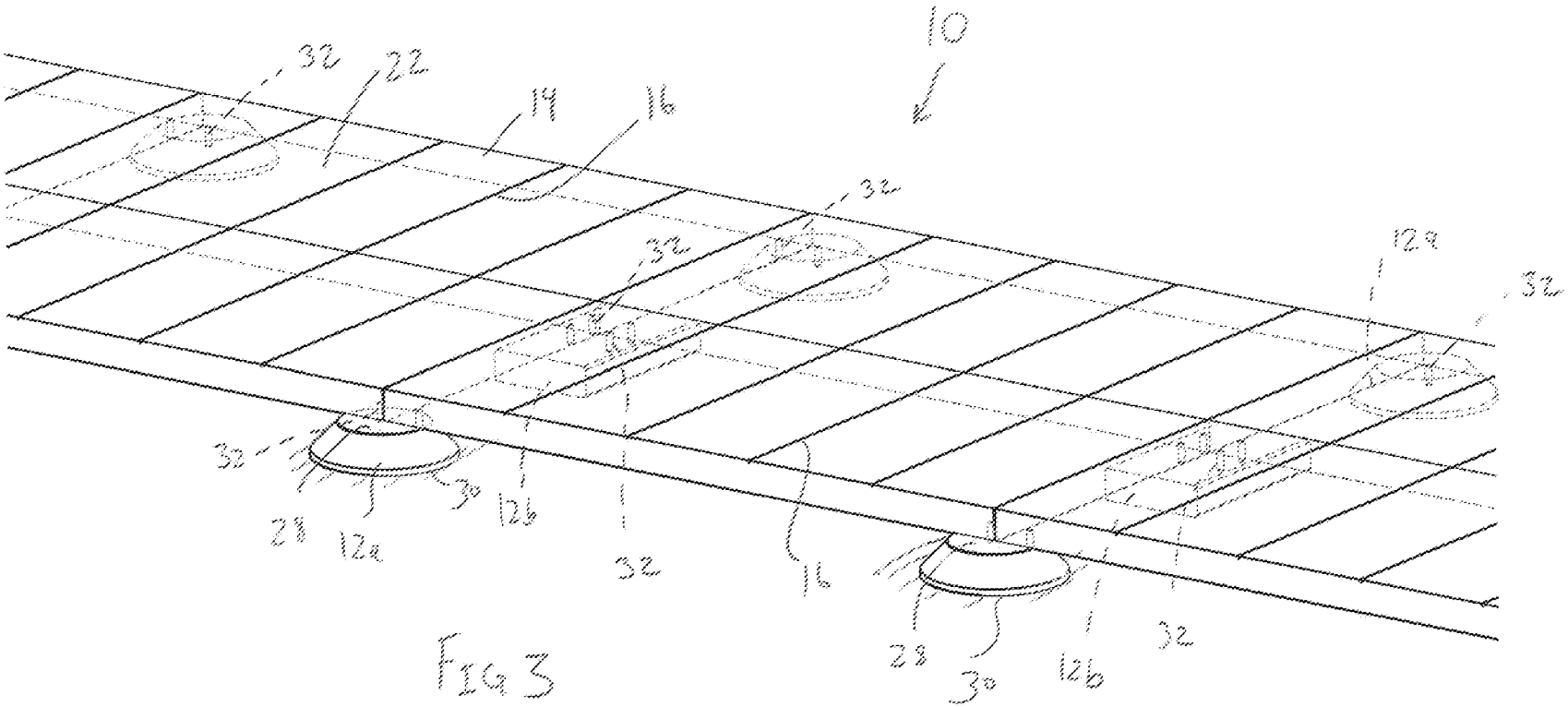
FIG. 3 is a front perspective view of the boardwalk system of FIG. 2, showing certain hidden features thereof.

As shown in FIGS. 2 and 3, in one embodiment the boardwalk system 10 includes a plurality of piers, footings, or bases 12 (collectively termed a "base" or "bases" herein), each of which is configured to rest on an underlying ground surface and support one or more horizontally-extending treads 14 thereon. With reference to FIG. 1, each tread 14 can be shaped as a generally rectangular prism having a length extending along a longitudinal direction L (in one case extending along a longest dimension of the tread 14 and/or system 10) and a width extending along a lateral/transverse direction W, perpendicular to the longitudinal direction L and positioned within a plane of the upper/walking surface of the tread 14 and/or system 10. Each tread 14 can be generally flat and planar and have varying dimensions, but in one case each tread 14 has a thickness (extending in the thickness direction T) that is relatively small (e.g. in one case less than about 10% of the length and/or width of the tread 14). In one case each tread 14 has a length of between about 4 feet and about 15 feet (or greater than about 4 feet in one case, or less than about 15 feet in another case), has a width of between about 2 feet and about 10 feet (or greater than about 2 feet in one case, or less than about 10 feet in another case), and has a thickness of between about 3 inches and about 10 inches (or greater than about 3 inches in one case, or less than about 10 inches in another case).

In one case the treads 14 are made entirely or primarily of concrete, either reinforced or unreinforced. In one case each tread 14 can be integral, unitary, seamless single piece (one piece) of material, such as concrete, formed in a single pour/cure process, and not formed of multiple pieces joined or coupled together. Each tread 14 can have one or more straight, continuous grooves 16 extending entirely or substantially (at least 90% in one case) across the tread 14 in the transverse/width direction W.

As shown in FIG. 2, each groove 16 can have a flat bottom surface 18 in one case, and can have sidewalls 20 that extend strictly vertically (when the system 10 is installed), or that form an angle with the vertical direction of less than about twenty degrees in one case, or less than thirty-five degrees in another case, for ease of manufacturing and cleaning. Each groove 16 can, at its widest (upper-most) point, have a width in the direction L of between about ¼ inch and about ¾ inch. Each groove 16 may extend at least about 5% in one case, or at least about 10% in another case, of the thickness of the tread 14 to provide sufficient visibility and functionality, as described below. Each groove 16 may extend less than about 25% in one case, or less than about 10% in another case, of the thickness of the tread 14 to avoid unduly compromising the strength of the tread 14 and to provide ease of cleaning.

When the treads 14 are made of a single piece of material, such a concrete, the grooves 16 can enable the treads 14 to present the appearance of a plurality of discrete planks 22, which can be more aesthetically pleasing and/or present the appearance of more labor intensive installation. The grooves 16 can also provide water or fluid drainage/collection, along with a collection location for dust or small debris/particles. By providing a single tread 14 with a plurality of "planks" 22 (or simulated plans 22) the system 10 can be installed more quickly, as each "plank" 22 does not need to be individually placed and secured. In addition, the use of a single, unitary tread 14 can provide greater stiffness and structural integrity as compared to the use of separate planks, and can be easier to store and transport.

If desired, at least the upper surface of each tread 14 can be textured, such as by sandblasting or other treatment, to present an aesthetically pleasing appearance and to improve gripping and reduce slippage. Each tread 14 can have a dynamic coefficient of friction (DCOF) of greater than about 0.42 in one case (in both wet and dry conditions), and greater than about 0.6 in another case, as measured ANSI 326.3 American Standard Test Method for Measuring Dynamic Coefficient of Friction of Hard Surface Flooring Materials, which standard is entirely incorporated by reference herein. The treads 14 in particular provide a good wet measurement of DCOF. Many surfaces have a lower wet DCOF compared to a dry DCOF, as most surfaces would expect to be more slippery when wet. However the treads 14, particular when made of textured concrete, can retain a high DCOF even when wet. In addition, the treads 14 can be presented in any of a wide variety of colors.

In the illustrated embodiment, each tread 14 has four grooves 16 to present the appearance of five planks 22, although the number of grooves 16 can be varied as desired, with at least one groove 16 being utilized in one case. Each plank 22 defined by a groove or grooves can have a dimension, in the longitudinal direction L, of between about 3 inches and about four feet in one case, or greater than about 3 inches in one case, or less than about 4 feet in another case.

Each tread 14 can be supported by a plurality of bases 12, each base 12 being supported on a ground surface and positioned below each tread 14, in one case, at or adjacent to a corner of the associated tread 14. The boardwalk system 10 can include a plurality of treads 14 arranged side-by-side in the width or transverse direction W and a plurality of treads 14 arranged end-to-end in the longitudinal direction L. As shown in FIGS. 2 and 3, in one case the boardwalk system 10 includes at least two treads 14 arranged side-by-side in the width direction W and at least four treads 14 arranged end-to-end in the length direction L. In another case the system 10 can include at least ten treads 14 arranged end-to-end, or however many treads 14 are needed to provide the desired width and length. The treads 14 arranged side-by-side define an inner edge 24 of the system 10 (or multiple inner edges 24, depending on how may treads 14 are arranged side-by-side), and the system 10 includes two opposed, outer longitudinal edges 26.

The system 10 can include a plurality of outer bases 12*a* positioned at or adjacent to the corner of each tread 14 and/or positioned along an outer edge 26 of the system 10. In the illustrated embodiment, each outer base 12*a* can be generally shaped as a conical portion, and includes a generally flat upper surface 28 which supports the associated tread(s) 14 thereon and a generally flat lower surface 30 supported on the ground surface, wherein in one case the upper surface 28 has a smaller surface area than the lower surface 30. In one case, at least part of an outer edge 26 and/or a corner and/or end surface 29 of a tread 14 is supported on the upper surface 28 (e.g. is positioned within an outer perimeter of the upper surface 28).

In the illustrated embodiment, each inner base 12*b* is generally shaped as a rectangular prism. Each inner base 12*b* can be positioned adjacent to and span the inner edge(s) 24 of the system 10 to thereby support the inner portions of two adjacent treads 14 thereon, and can be spaced away from the outer edges 26 of the system 10.

The inner bases 12*b* can be formed as rectangular prisms to provide a stronger and more robust base 12 since the inner bases 12*b* can have more loading and carry more weight as compared to the outer bases 12*a*. However the inner bases 12*b* can also be shaped as conical portions (or other shapes) and/or the outer bases 12*a* can be shaped as rectangular prisms (or other shapes). The bases 12*a*, 12*b* can be made of a wide variety of materials, such as concrete, metal, composites or the like. In one case, each base 12 has a relatively small height, such as less than about two feet in one case, and less than about one foot in another case, and less than about nine inches in yet another case to provide a relatively low profile base 12 to enable the system 10 to have a relatively low height, as described in greater detail below.

Figure 4:
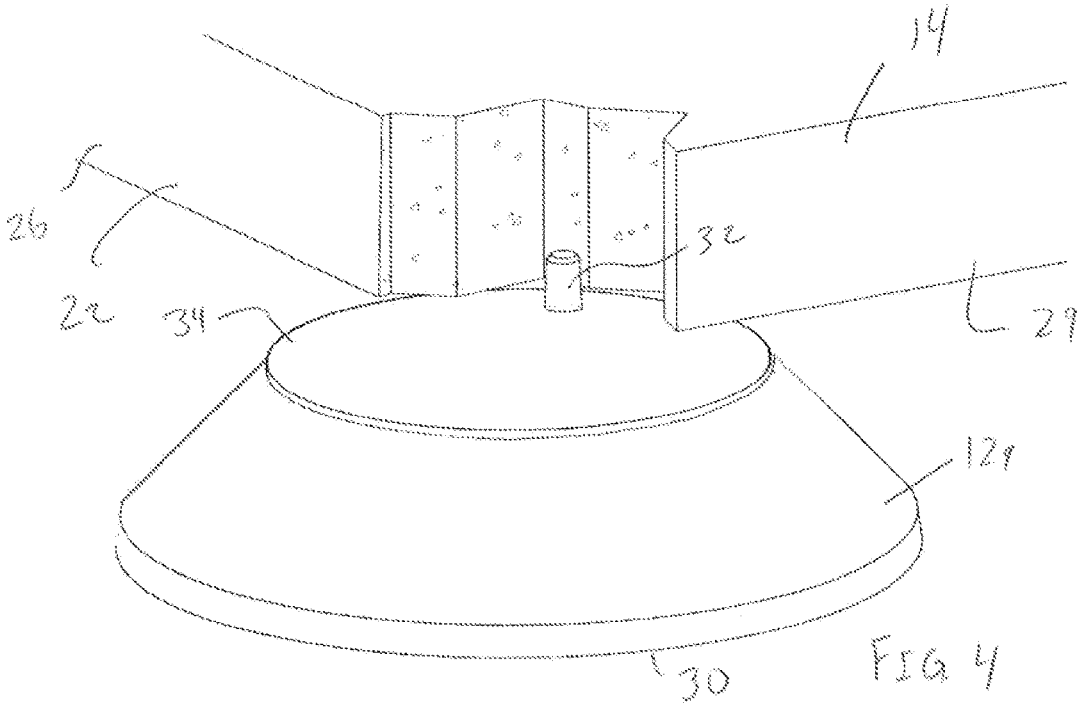
FIG. 4 is a detail perspective view showing a connection of an outer base to a tread, with a portion of the tread cut away.
Figure 5:
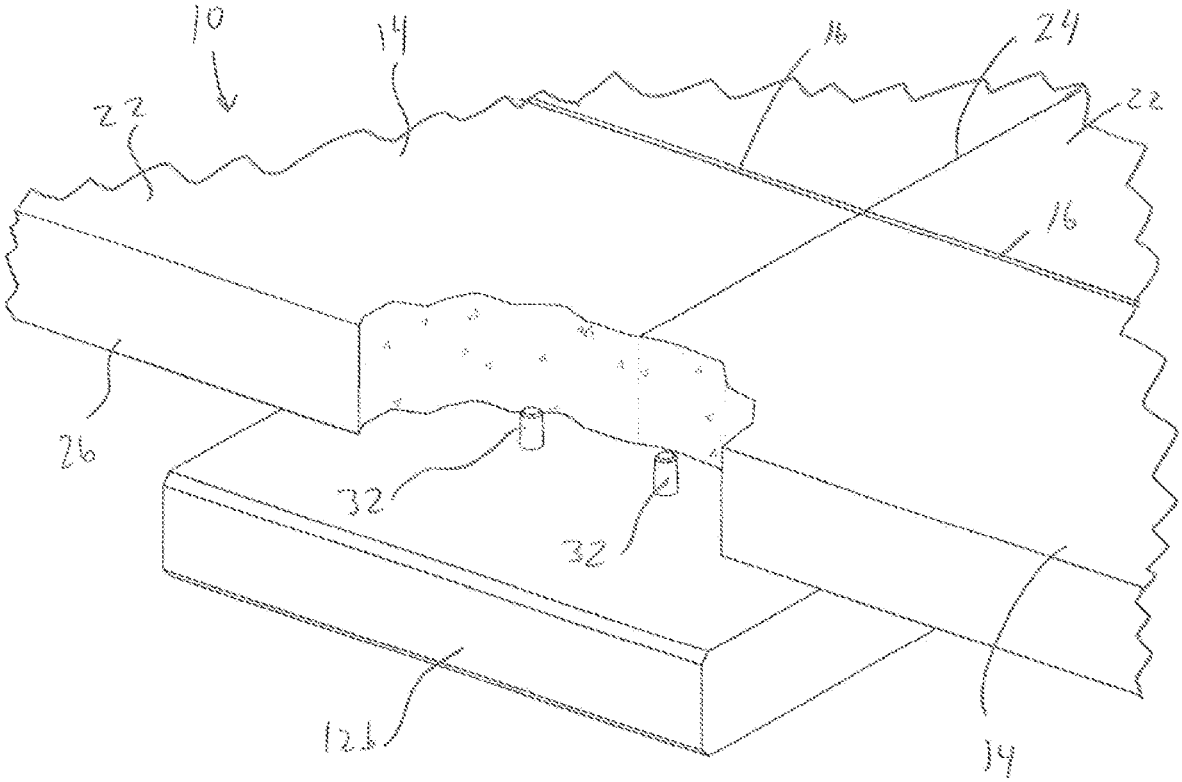
FIG. 5 is a detail perspective view showing a connection of an inner base to two treads, with a portion of the treads cut away.

As shown in FIGS. 3-5, the system 10 can include a plurality of pins 32 extending between a upper surface of each base 12 and lower surface of each tread 14 to thereby couple each tread 14 to each base 12. In particular, the lower surface of each tread 14 can have one or more pockets, holes or openings (collectively termed openings herein) that at least partially (partially or, in one case, fully) extend through a thickness thereof and closely receives a pin 32 therein. The upper surface of base 12 can have corresponding openings at least partially extending therethrough that closely receives the pin 32 therein. Each base 12 may have at least one pin 32 that couples the base 12 to each tread 14 supported by that base 12. The pins 32 can in one case be generally tubular or generally cylindrical, and can be made of a noncorrosive material and/or made of polymer such as polyurethane, but can also be made of metal such as galvanized steel, composites, concrete, wood, etc. Moreover, as shown in FIG. 4, in one case a gasket 34, such as a rubber, synthetic rubber or other similar material, can be positioned between the base 12 and the tread 14 (and/or be considered part of the base 12), which receives a pin 32 therethrough. The gasket 34 can reduce impact and rubbing forces between the base 12 and the tread 14 and thereby extend the life of the system 10.

In the current system, the treads 14 can be placed and supported directly on an underlying base 12. In contrast, in many existing systems, a series of longitudinally extending beams are placed on the bases, and laterally extending treads are then spanned across the longitudinally extending beams. However, such systems that use beams raise the height of the treads, and increase the complexity of the resultant system due to the presence of the beams. In contrast, the current system 10 can eliminate the use of transverse beams, and provides a system 10 that is easier to install, and is lower-profile. In particular, in one case a distance between the upper surface of the treads 14, and the ground surface (assuming a flat ground surface), and/or a lower surface of the base 12, is less than about eighteen inches in one case, or less than about twelve inches in another case. In another case a distance between the lower surface of the treads 14, and the ground surface (assuming a flat ground surface), and/or the lower surface of the base 12 is less than about twelve inches in one case, or less than about six inches in another case.

The current system 10 is modular and thus can be quickly and easily assembled and disassembled. In particular, in order to assemble the system 10, the bases 12 are located in the desired position, and pins 32 positioned in the openings. The treads 14 are then placed on the bases 12, with the pins 32 received in openings on the underside of the treads 14. No excavation or pouring of footers is necessarily needed. In addition, the resultant system 10 is low profile and located close to the ground, and provides a shallow structure depth which can be useful where there is limited grade separation. Any movement or heaving of the underlying ground surface is automatically accommodated by movement of the bases 12. The spaces underneath each tread 14 and between the bases 12 allow for the positioning and growth of tree roots, movement of small animals, increased air flow, etc. while providing good structural integrity and design flexibility.

Figure 6:
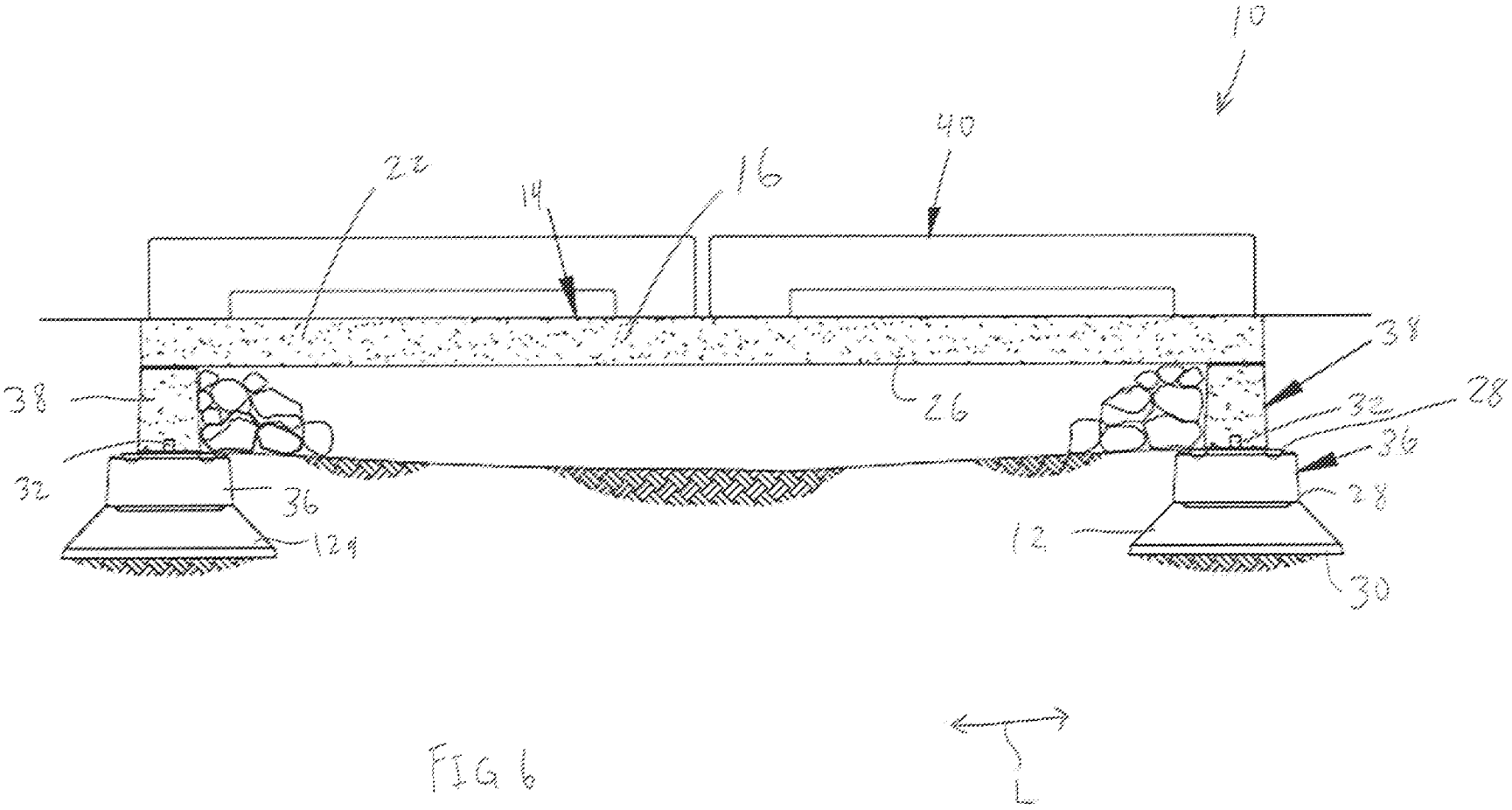
FIG. 6 is a side view of an alternative embodiment of a boardwalk system.
Figure 7:
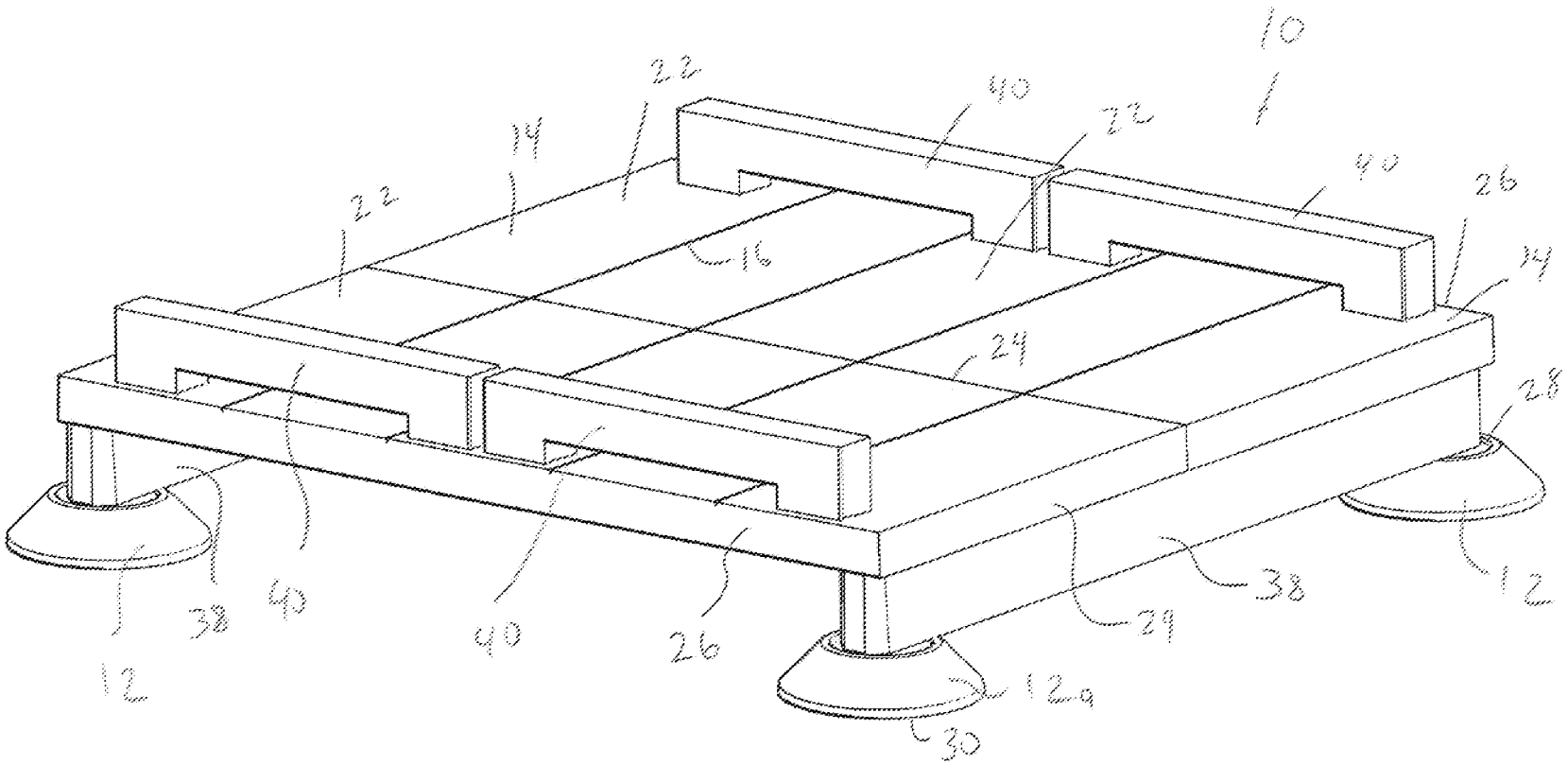
FIG. 7 is a perspective view of the system of FIG. 6, without the extensions.

As shown in FIG. 6, in an alternate embodiment, each base 12 includes or has an extension 36 positioned thereof. As shown in FIGS. 6 and 7, each base 12/extension 36 can have a beam 38 positioned thereon which in turn supports a tread 14 or treads 14 thereon. The system of FIGS. 6 and 7 incorporates beams 38, but the beams 38 extends in the transverse/width direction W, rather than the longitudinal direction L and are included primarily to increase the height/clearance of the treads 14 as necessary. In addition, the beams 38 can pass under adjacent treads 14 in the width direction W and thus support the inner edges 24 of adjacent treads 14 such that the inner bases 12*b* may not be required.

In one case the beams 38 extend the entire width W of the system, extending between the outermost bases 12.

The system 10 of FIGS. 6 and 7 can also include curb components 40 positioned on or adjacent to the outer edges 26 of the treads 14 to acts as a rail guard/safety component. The system 10 of FIGS. 6 and 7 can be used in a variety of settings, including over relatively shallow grade separations, over tree roots and swale crossings, and as temporary bridge crossings. If desired, any or all of the components shown in the FIG. 6/7 embodiment(s) can be used with the components shown in FIGS. 1-5.

Having described the invention in detail and by reference to certain embodiments, it will be apparent that modifications and variations thereof are possible without departing from the scope of the invention.

What is claimed is:

1. A boardwalk system comprising:

a plurality of treads, wherein each tread is a single piece of material, each tread including a plurality of grooves extending entirely or substantially entirely thereacross in a direction transverse to a length of the tread, wherein each groove extends at least about 5% of a thickness of the associated tread, wherein the grooves are shaped and configured such that each tread presents an appearance of a plurality of planks, and wherein each tread is made of concrete; and a plurality of bases, each base being supported on a ground surface and positioned below each tread at or adjacent to a corner of the associated tread, wherein each base is a discrete component spaced away from and not directly coupled to any adjacent base.

2. The system of claim 1 wherein a distance between an upper surface of each tread and a lower surface of the associated base is less than about 18 inches.

3. The system of claim 1 wherein each groove is straight and continuous, and extends less than about 25% of a thickness of the associated tread, wherein each tread is a unitary, seamless single piece of concrete.

4. The system of claim 1 wherein each base has a flat upper surface which supports the tread thereon and a flat lower surface supported on a ground surface, and wherein the upper surface has a smaller surface area than the lower surface.

5. The system of claim 1 wherein the boardwalk system includes a plurality of treads arranged side-by-side and a plurality of treads arranged end-to-end.

6. The system of claim 1 wherein the boardwalk system includes at least two treads arranged side-by-side and at least ten treads arranged end-to-end.

7. The system of claim 1 wherein the boardwalk system includes at least two treads arranged side-by-side along an inner edge of the system, and wherein the plurality of bases includes at least two inner bases, wherein each inner base spans the inner edge and at least partially supports each of the at least two treads thereon.

8. The system of claim 7 wherein the plurality of bases include at least four outer bases which are positioned along outer edges of the system.

9. A boardwalk system comprising:

a plurality of treads, each tread including a plurality of grooves extending entirely or substantially entirely thereacross in a direction transverse to a length of the tread, wherein each tread is made of concrete; and a plurality of bases, each base being supported on a ground surface and positioned below each tread at or adjacent to a corner of the associated tread, wherein the boardwalk system includes at least two treads arranged side-by-side along an inner edge of the system, and wherein the plurality of bases includes at least two inner bases, wherein each inner base spans the inner edge and at least partially supports each of the at least two treads thereon, wherein the plurality of bases include at least four outer bases which are positioned along outer edges of the system, and wherein each of the inner bases are generally shaped as rectangular prisms, and each of the outer bases are generally shaped as conical portions.

10. The system of claim 1 further comprising a plurality of pins extending between an upper surface of each base and lower surface of each tread to thereby couple each tread to each base.

11. The system of claim 1 wherein an upper surface of each tread is textured at a shallower depth than the plurality of grooves.

12. The system of claim 1 wherein each tread is directly supported only on any associated bases, and wherein the system lacks any beams extending in a longitudinal direction between the bases and supporting a tread thereon.

13. The system of claim 1 further including a beam extending between at least two bases in the transverse direction, wherein the beam is positioned on the at least two bases and wherein the plurality of treads are positioned on the beam.

14. A method for assembling a boardwalk system comprising:

accessing a plurality of treads, each tread including a plurality of grooves extending entirely or substantially entirely thereacross in a direction transverse to a length of the tread, wherein each groove extends at least about 5% of a thickness of the associated tread, wherein the plurality of grooves are shaped and configured such that each tread presents an appearance of a plurality of planks, and wherein each tread is made of concrete;

positioning a plurality of concrete bases on a ground surface; and positioning each tread on a base positioned below each tread at or adjacent to a corner of the associated tread.

15. A boardwalk system comprising:

a plurality of treads, each tread including a plurality of grooves extending entirely or substantially entirely thereacross in a direction transverse to a length of the tread, wherein each groove is spaced apart from any immediately adjacent groove by greater than three inches, wherein the plurality of grooves are shaped and configured such that each tread presents an appearance of a plurality of planks, and wherein each tread is made of concrete; and a plurality of concrete bases, each base being supported on a ground surface and positioned below each tread to support at least one tread thereon.

16. A tread that is made of concrete and includes a plurality of grooves extending entirely or substantially entirely thereacross in a direction transverse to a length of the tread, wherein each groove is straight and continuous, and extends at least about 5% and less than about 25% of a thickness of the tread, wherein the tread is a unitary, seamless single piece of concrete, and wherein the grooves are shaped and configured such that the tread presents an appearance of a plurality of planks, and wherein each groove has a width of between about ¼ inch and about ¾ inch.

17. The tread of claim 16 wherein each groove extends less than about 10% of a thickness of the tread.

18. The system of claim 1 wherein each base is a discrete component spaced away from and not directly coupled to any adjacent base by a structure positioned on the ground surface.

19. The system of claim 1 wherein each groove extends less than about 25% of a thickness of the tread.

20. The system of claim 1 wherein each groove is spaced apart from any immediately adjacent parallel groove by less than about 4 feet.

21. The system of claim 1 wherein each base is made of concrete.

22. The system of claim 1 wherein each groove extends at least about 10% of a thickness of the associated tread.

* * * * *